US007250021B2

(12) United States Patent
Leight

(10) Patent No.: US 7,250,021 B2
(45) Date of Patent: Jul. 31, 2007

(54) ADJUSTABLE PULL-ROPE EXERCISE DEVICE

(76) Inventor: Howard S. Leight, 2828 Donald Douglas Loop North, Sutie 102, Santa Monica, CA (US) 90405

( * ) Notice: Subject to any disclaimer, the term of this patent is extended or adjusted under 35 U.S.C. 154(b) by 15 days.

(21) Appl. No.: 11/202,129

(22) Filed: Aug. 11, 2005

(65) Prior Publication Data

US 2006/0046911 A1 Mar. 2, 2006

Related U.S. Application Data

(60) Provisional application No. 60/605,227, filed on Aug. 27, 2004.

(51) Int. Cl.
*A63B 21/015* (2006.01)
*A63B 21/002* (2006.01)
*A63B 21/02* (2006.01)

(52) U.S. Cl. ..... 482/116; 482/91; 482/126; 482/127

(58) Field of Classification Search ..... 482/122, 482/123, 126, 127, 116, 120, 908, 91
See application file for complete search history.

(56) References Cited

U.S. PATENT DOCUMENTS 1,372,026 A 3/1921 Hutter
3,021,089 A 2/1962 Becker
3,352,559 A * 11/1967 Larsen ..... 473/269
3,369,809 A * 2/1968 Morrill, Jr. ..... 482/91
3,843,119 A 10/1974 Davis
4,114,875 A * 9/1978 Deluty ..... 482/120
4,257,592 A * 3/1981 Jones ..... 482/131
4,391,440 A 7/1983 Berger
4,501,230 A * 2/1985 Talo ..... 119/796
4,645,204 A * 2/1987 Berger ..... 482/123
4,863,163 A * 9/1989 Wehrell ..... 482/123
5,171,295 A 12/1992 Schwalm, Jr.

(Continued)

FOREIGN PATENT DOCUMENTS

DE 42 36 208 4/1994

(Continued)

*Primary Examiner*—Stephen R. Crow
*Assistant Examiner*—Allana Lewin
(74) *Attorney, Agent, or Firm*—Leon D. Rosen

(57) ABSTRACT

A compact exercise device (10) of the type wherein a person grips handle devices (12, 30) lying at opposite ends of a rope that extends through a housing (22), the person pulling one end of the rope away from the housing while resisting movement of the other end of the rope towards the housing to exercise. A windup spool (114) lies in one of the handle devices and a spring (130) urges the spool to wind up rope by a spring, but the spool is normally prevented from turning in either direction by a release mechanism (110). A person who holds a handle grip (100) with most fingers of his/her hand, uses his/her thumb to depress a button (90) to operate the release mechanism. While the thumb continues to depress the button, the person moves a handle device away from the housing to lengthen the effective length of rope, or moves a handle device towards the housing to shorten the effective length of rope. In another device, windup spools (226, 228) lie in the housing, and a person depresses a button (202) on the housing to operate the release mechanism.

15 Claims, 7 Drawing Sheets

U.S. PATENT DOCUMENTS

| | | | | |
|---|---|---|---|---|
| D353,419 | S | 12/1994 | Sprague | |
| 5,540,642 | A * | 7/1996 | Sprague | 482/123 |
| 5,876,310 | A * | 3/1999 | Mackey et al. | 482/74 |
| 5,937,476 | A | 8/1999 | Kim | |
| 5,984,844 | A | 11/1999 | Royer | |
| 6,210,348 | B1 * | 4/2001 | Reed | 601/23 |
| 6,315,701 | B1 * | 11/2001 | Shifferaw | 482/114 |
| 6,405,683 | B1 * | 6/2002 | Walter et al. | 119/772 |
| 6,729,815 | B2 * | 5/2004 | Hornady | 410/47 |
| 7,086,512 | B2 * | 8/2006 | Shack et al. | 191/12.4 |
| 2003/0114278 | A1 * | 6/2003 | Rigas | 482/116 |
| 2003/0153441 | A1 * | 8/2003 | Berns et al. | 482/128 |
| 2004/0043873 | A1 | 3/2004 | Wilkinson et al. | |

FOREIGN PATENT DOCUMENTS

| | | |
|---|---|---|
| EP | 0 821 983 | 2/1998 |
| FR | 2 694 202 | 7/1992 |
| FR | 2 741 273 | 11/1995 |

* cited by examiner

ADJUSTABLE PULL-ROPE EXERCISE DEVICE

CROSS-REFERENCE

Applicant claims priority from U.S. provisional application Ser. No. 60/605,227 filed Aug. 27, 2004.

BACKGROUND OF THE INVENTION

One common type of exercise apparatus includes a rope that extends though a housing, with handle devices at opposite ends of the rope. A person pulls one end of the rope away from the housing while resisting movement of the opposite end of the rope towards the housing. One problem with this type of apparatus is adjusting the effective length of the rope, which can be considered to equal the sum of the lengths of rope portions extending from the housing to the two handle devices. For example, a tall person who is standing on the housing and moving the handles up and down may be most comfortable with a long rope, while a shorter person may desire a somewhat shorter rope effective length. A person may want to move the handles with his/her feet while sitting closely over the housing, using a short rope. A person can best choose the right rope length by lengthening or shortening the rope while the person is in the position that he/she will use during the exercise and is grasping grips on the handle devices. Once the proper length is found, the person may not want that length to change during interruptions in exercise.

One method for changing rope length, described in U.S. Pat. No. 6,315,701 by Shifferaw, uses handle devices that each has a shaft and a crossbar. The rope is continually urged to wind up on spools in the handle devices. A person first grasps or pushes on the crossbars to pull the handle devices away from the housing to lengthen the rope. The person then switches to the shafts and grasps them tightly to prevent shortening or lengthening of the rope. When the person stops tightly grasping the handles, the rope automatically tends to shorten until the handles have been fully retracted and lie against the housing. Such person cannot avoid retraction by merely laying the handles on a chair or other surface that lies above the housing. The exercise device cannot be used in a mode wherein the handle devices are moved by the person's feet, since the shaft then will not be firmly grasped and the rope then will continually length and shorten by turning of the spools. A pull-rope device that allowed a person to easily adjust rope length, without requiring changing of grip, and without requiring continuous grasping of a shaft, would be of value.

SUMMARY OF THE INVENTION

In accordance with one embodiment of the invention, applicant provides an exercise apparatus of the type wherein handle devices are coupled to opposite ends of a rope that passes through a housing and the handle devices are moved toward and away from the housing, which allows very easy control of a windup spool to change the effective length of the rope and to maintain the length of rope that was last chosen. The handle devices each includes a grip that is grasped by a person's hand. The exercise device includes a manually operable element that operates a release mechanism to release the spool to wind up or pay out rope, wherein the operable element is positioned to be manually operated or not operated while the person continues to grasp the grips.

In one exercise apparatus, the manually operable element is mounted on one of the handles. The manually operable element is preferable mounted so that while fingers of a person's hand grasp a handle grip, the thumb of the same person's hand can operate the release element as by depressing it. In another exercise device, the operable device is mounted on the housing. In that case, a person can operate the element as by using a foot to depress a button on the housing, while grasping the grips of the handles. In the latter case, the element releases two spools that each hold rope that extends to only one of the handle devices.

The housing has one or two rope guides that guide a moving rope portion. Each rope guide includes two upper rollers that are rotatable about parallel axes, and a lower roller that is rotatable about an axis that is perpendicular to the axes of the upper ones. In an exercise device with two laterally spaced rope guides, the rope may pass down though the space between a first pair of upper rollers and around the first lower roller, though the housing to the second lower roller, and then around the second lower roller and up though the space between the second upper rollers. In a device with one rope guide, the rope extends down though the space between upper rollers, then around the lower roller, and then up through the space between the upper rollers.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
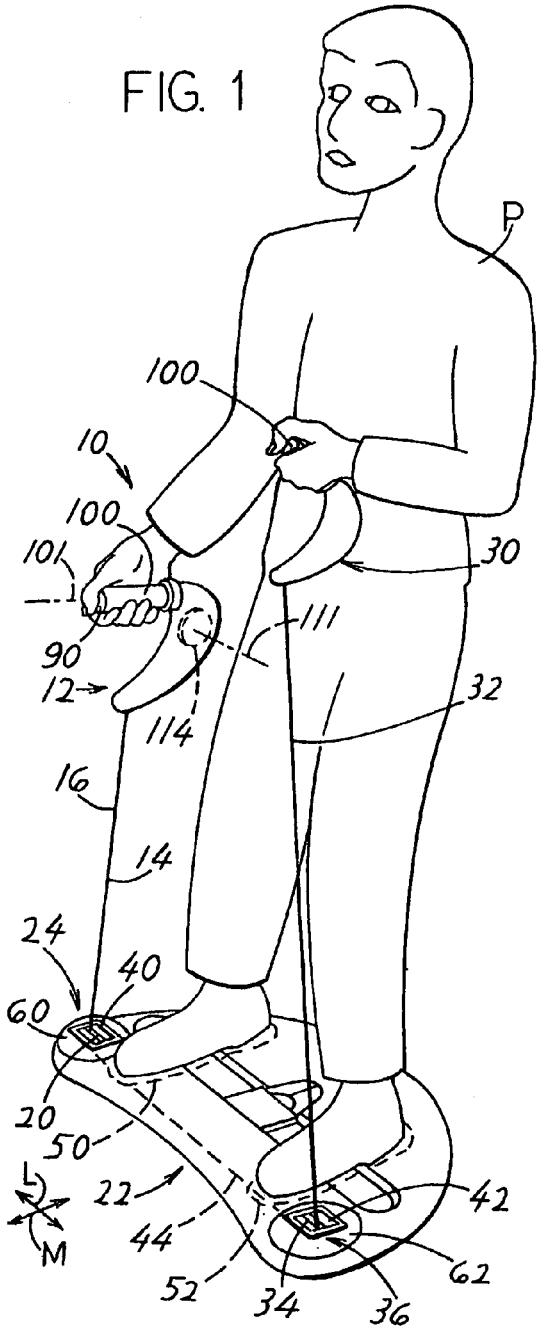
FIG. 1 is a front isometric view of an exercise apparatus of a first embodiment of the invention, wherein the housing contains two rope guides and the spool is mounted in a handle device.

This invention provides a compact exercise apparatus of a type shown in FIG. 1 at 10, wherein a person P pulls on a first handle device or handle 12 that lies at a first end portion 14 of a cable 16 (a strong rope) to pull the cable. The cable, or rope is pulled out of a first port 20 in a guiding housing 22 through a first cable guide 24, with resistance to pullout of the cable providing exercise. Resistance to cable pullout from the first port of the housing is provided by the person holding a second handle device 30 at an opposite second end portion 32 of the rope. The second end portion of the rope moves into a second port 34 of the housing, through a second cable guide 36, as the cable first end portion is pulled out of the housing. The present invention provides a low cost, compact, and easily used exercise device that allows the person using the device to very easily adjust the length of the rope 16 to the ideal length for that particular person during the particular exercise being performed, and with the rope length remaining constant until changed.

Each cable guide 24, 36 includes two sets of rollers 40, 42 at the two ports 20, 34, that guide the cable so a middle portion 44 of the cable extends through the housing between the sets of rollers and ports. When a person pulls up on one handle device such as 12 and allows the second handle device to move down, but with resistance, there is a net upward force on the housing. Applicant instructs the person who is exercising to stand on the device to hold it down, in the situation illustrated in FIG. 1. Applicant provides foot placement indications at 50 and 52, in the form of foot outlines, to help the person properly stand on the housing. The exercise device can be used in other situations, as where the cable guide is held in place as by a chair on which the exercising person is seated, or is held in place by the buttocks of a person sitting on the housing, etc.

The housing has a pair of mounds, or raised locations 60, 62 around the ports 20, 34 where the cable moves into and out of the housing. The mounds clearly indicate to the person who is exercising to not place a foot over one of the ports. A steel cable or rope can cut a person's shoe if the cable rubs against the shoe while the cable moves into and out of a port.

Figure 4:
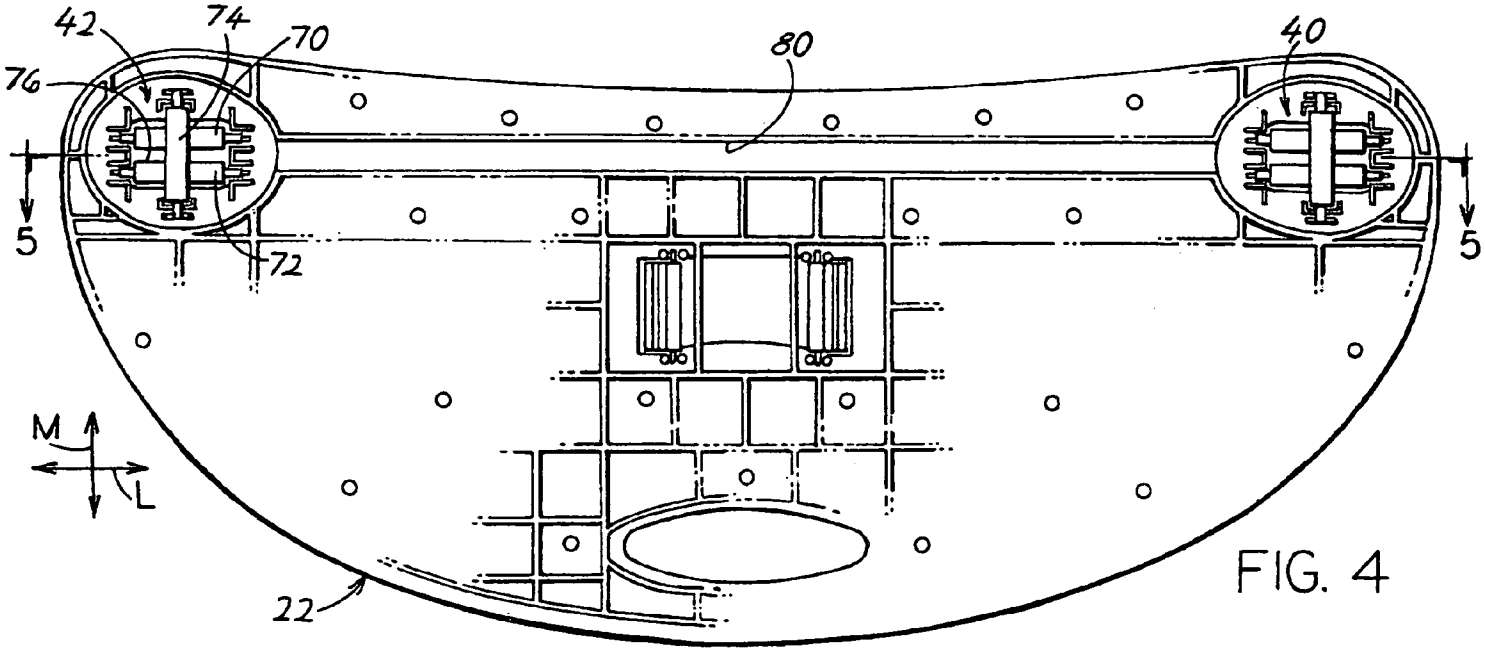
FIG. 4 is a bottom view of the housing of FIG. 2, with the bottom cover removed.
Figure 5:
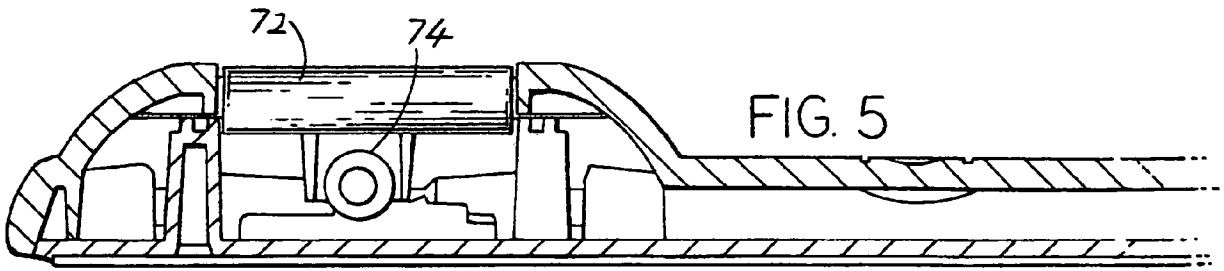
FIG. 5 is a partial sectional side elevation view of the housing of FIG. 4, showing one of the rope guides thereof.

As shown in the bottom view of FIG. 4 and the sectional view of FIG. 5 which is taken on line 5-5 of FIG. 4, each set of rollers 40, 42 includes a pair of upper rollers 70, 72 and a single lower roller 74. The upper rollers are mounted to turn about laterally L extending horizontal axes , while the lower roller is mounted to turn about a longitudinal horizontal axis M which is perpendicular to the upper roller axes. The two upper rollers and the lower roller, each has a primarily cylindrical surface of a length of a plurality of times the rope diameter (the rope fits in gap 76). The cable extends though a gap 76 between the upper rollers, and extends about 90° around the lower roller and towards the other set of rollers. A passage 80 in the housing extends between the two sets of rollers 40, 42. The guide housing can work well even though it has only a small height, because the passage 80 for the cable middle portion can have a small height, and only a small additional height is added by the mounds 60, 62 that protect the person and provide space for the rollers.

One problem encountered in using the above exercise device 10 (FIG. 1) is that the length of cable 16 required for ease of exercise varies, depending upon the particular person and how he/she wishes to hold the handle devices during different stages of an exercise workout. Applicant enables change of cable length by the hand of the person holding a handle device 12, by the person merely depressing a movable element or member formed by a button 90 while grasping a handle grip 100 with perhaps four fingers of a hand, and moving the grip away from the housing 22 (while not moving the other handle device 30). As soon as the person finds that the cable is of the proper length, the person releases the button 90 and the length of cable is fixed. The person may then place his/her thumb around the grip. This procedure is not only very convenient, but allows the person to repeatedly adjust the cable length while holding the grips of the handle devices, and without requiring the help of another person.

Figure 6:
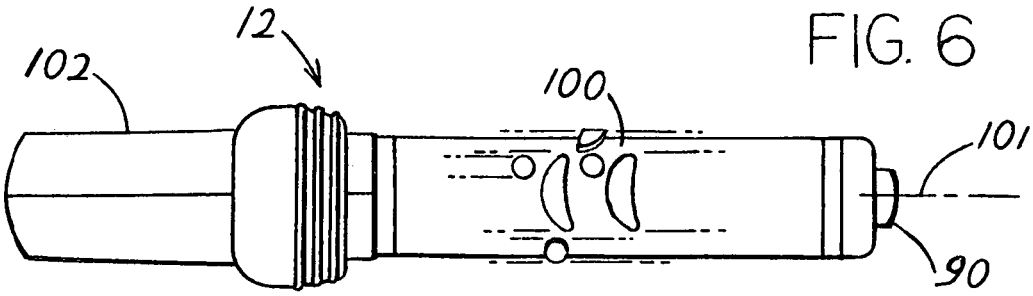
FIG. 6 is a plan view of one of the handle devices of the exercise apparatus of FIG. 1.
Figure 7:
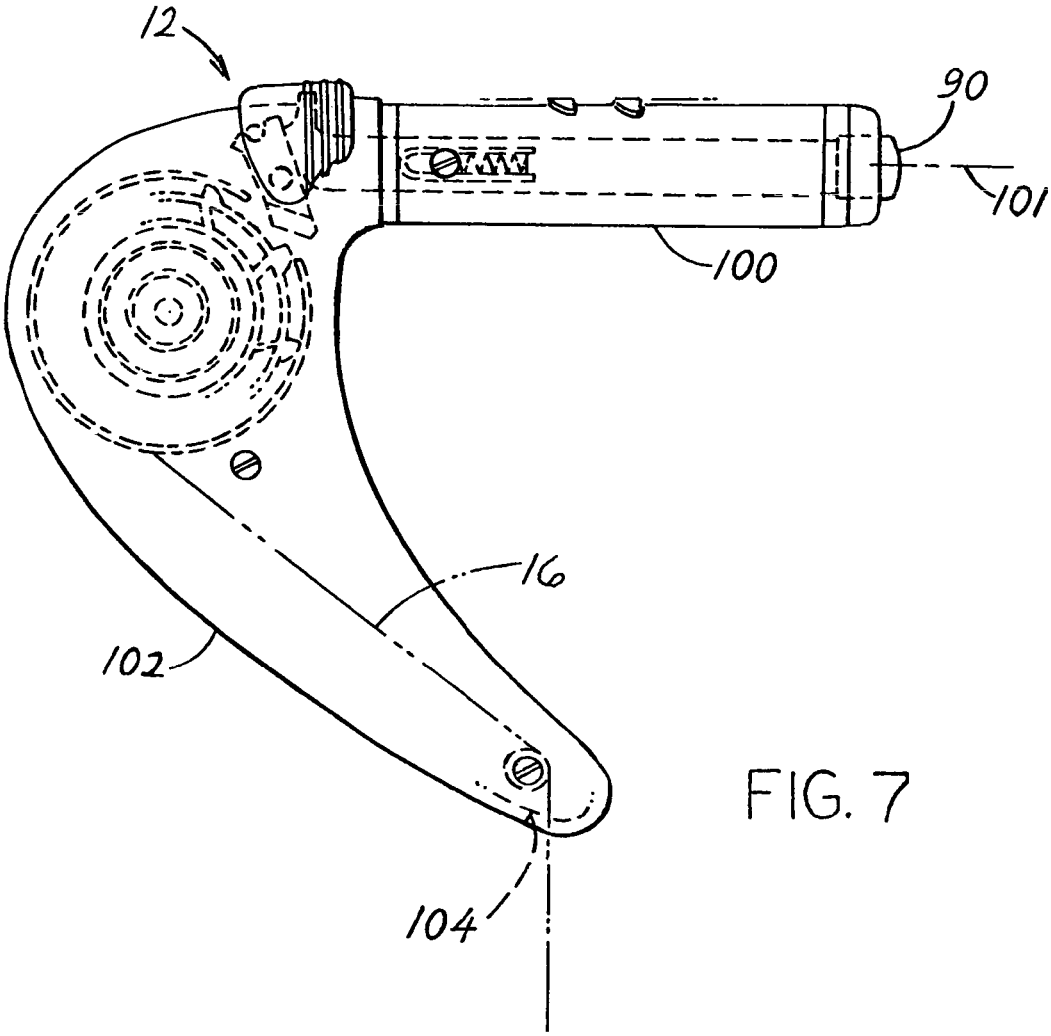
FIG. 7 is a side view of the handle device of FIG. 6 with some parts shown in hidden lines.

FIGS. 6 and 7 show that each handle device such as 12 has a grip 100 with an axis 101, and that is largely in the form of a shaft (elongated along the axis and capable of being grasped by fingers bent around the axis). The grip can be gripped by a plurality of fingers of a person's hand which are wrapped about the axis 101. A projection 102 projects from the handle. The projection has a slot 104 through which the cable extends. Only one of the handle devices 12 has a mechanism for extending the cable length or has a button 90 for operating the mechanism, although the other one 30 has a similar appearance.

Figure 8:
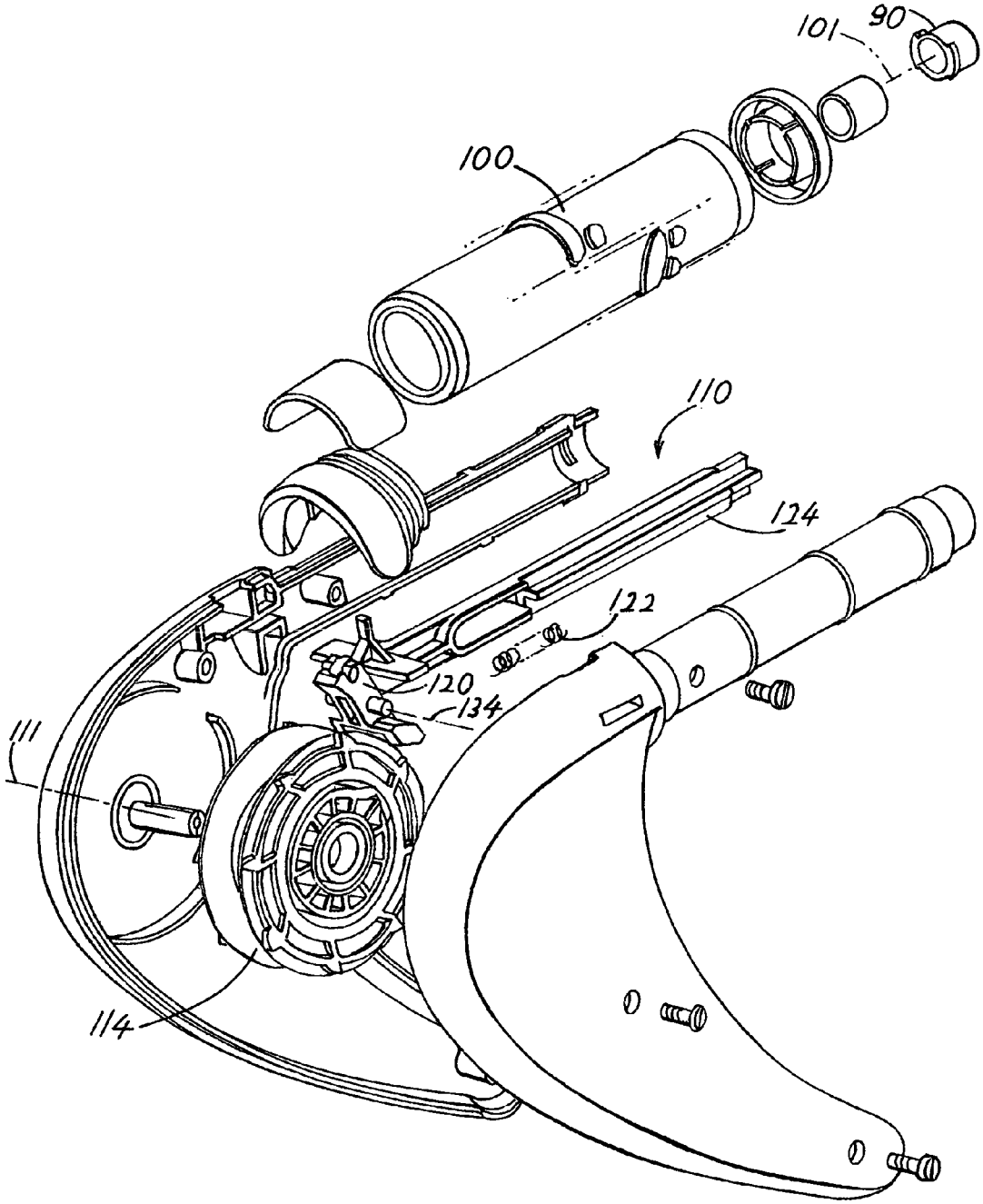
FIG. 8 is an exploded isometric view of the handle device of FIG. 7.

FIG. 8 shows details of a mechanism 110 for extending and shortening the cable length. The mechanism includes a spool 114 that is rotatable about an axis 111 that is perpendicular to the axis 101, of the grip 100. A person commonly holds the grip 100 as shown in FIG. 1 wherein the grip axis is perpendicular to the lateral direction L. The person's feet are spaced apart in the lateral direction L. In this position, the person moves the grips 100 up and down, turning them only about lateral L axes. Even though the spool has a considerable diameter, the handle will not hit the side of the person.

Figure 9:
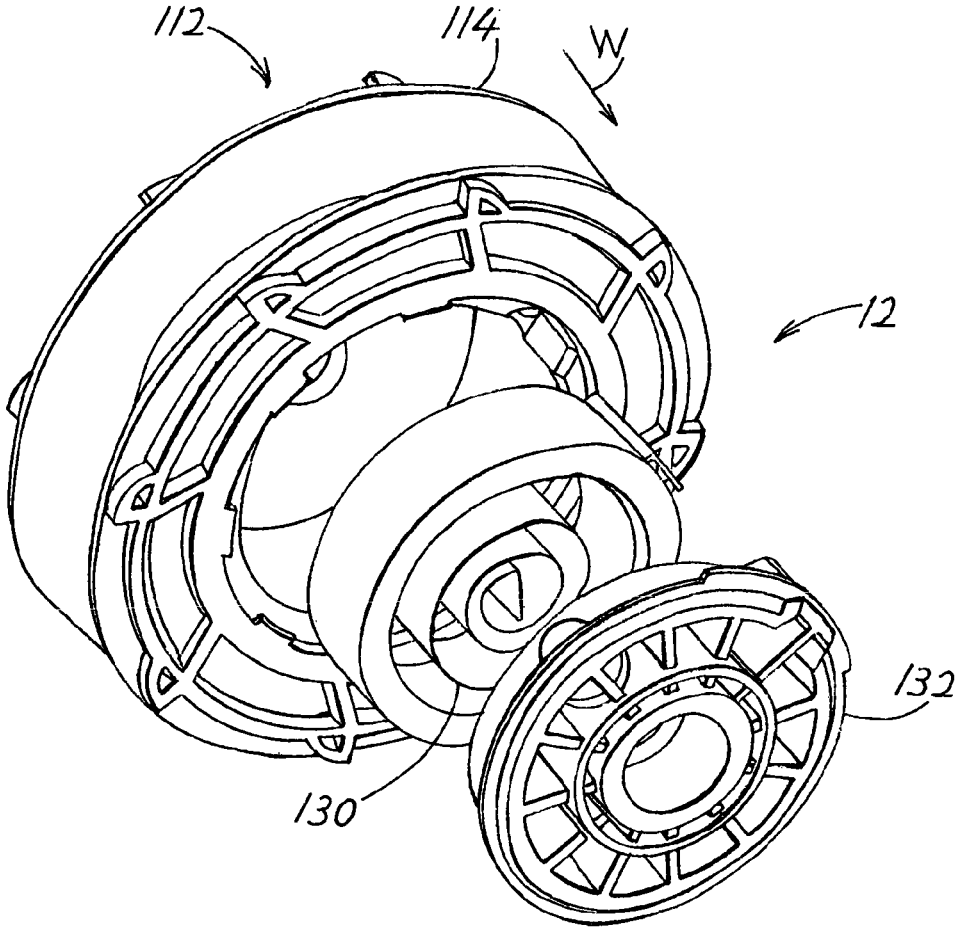
FIG. 9 is an exploded isometric view of a portion of the handle device of FIG. 8.

FIG. 9 shows that the mechanism includes a cable storer 112 that includes a spool 114 on which cable can be wound and unwound. A spiral band clock spring 130 urges the spool to turn in a windup direction W to wind cable on the spool. A spool cap 132 connects the windup spring to the spool. FIG. 8 shows that a catch or brake 120 that pivots about axis 134, is biased by a brake spring 122 to prevent the spool 114 from turning. The brake normally prevents the spool from turning to wind or unwind cable despite a large (e.g. 150 pound) force being applied to the cable to pull it. However, when the button 90 is depressed, it moves a plunger 124 that pivots the catch 120 to move it out of contact with the spool to allow the spool to turn to change cable length.

Figure 2:
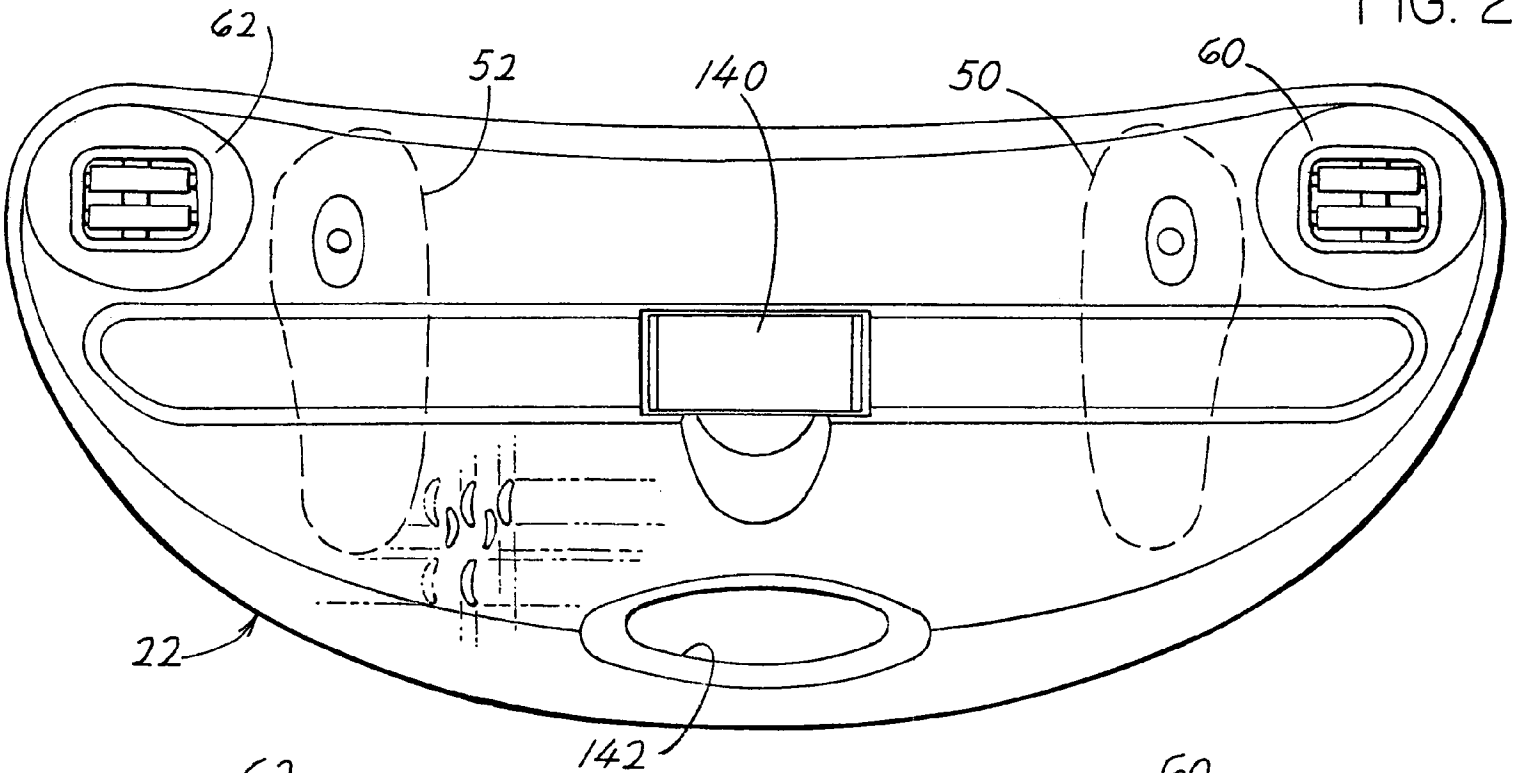
FIG. 2 is a plan view of the housing of the exercise apparatus of FIG. 1.
Figure 3:
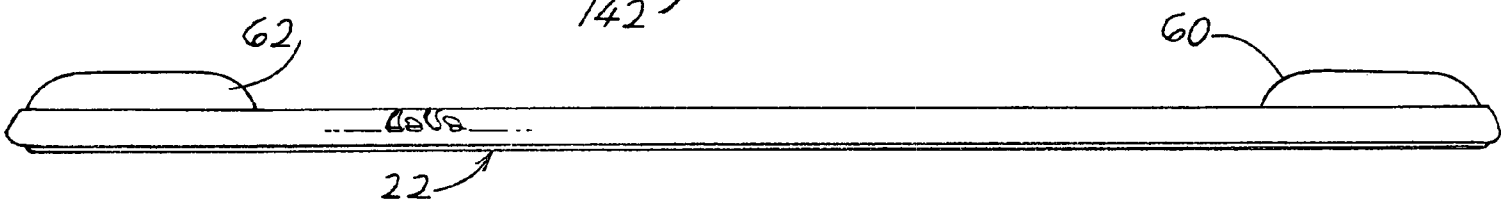
FIG. 3 is a rear elevation view of the housing of FIG. 2.

FIG. 2 shows that the housing 22 includes an elastomeric strap 140 with opposite ends mounted on the housing. The handles of the two handle devices can be slipped under the strap (preferably after the cable has been shortened) to hold the exerciser device in a compact configuration for carrying or storing. A handle slot 142 in the housing aids in carrying the unit.

Applicant has constructed and successfully tested an exercise apparatus, or unit of the construction illustrated. The unit has a housing length of 29.4 inches, a housing width of 12.6 inches, and a housing thickness (at the mounds) of 1.4 inch (not counting any rubber feet on the housing bottom). The unit has a total weight (including the handle devices) of 5.5 pounds.

Figure 10:
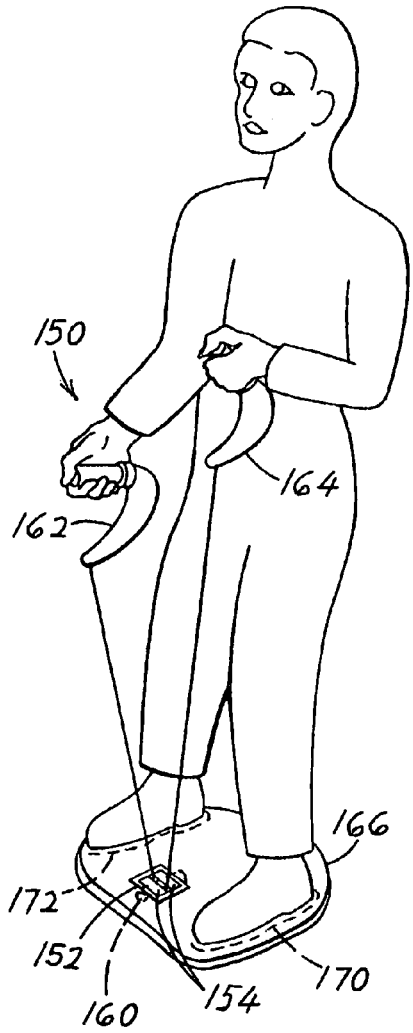
FIG. 10 is a front isometric view of an exercise apparatus of a second embodiment of the invention wherein the housing contains only one rope guide.

FIG. 10 illustrates a modified exercise apparatus 150 of smaller length. It includes a single set of rollers 152, which includes two parallel upper rollers 154 and a bottom perpendicular roller 160. The handle devices 162, 164 are the same as for the unit of FIGS. 1-9. The housing 166 is of smaller length because the foot-placing locations 170, 172 are at opposite ends of the housing. In FIG. 10 the rope extends down (at a downward incline) through the space between upper rollers, about 180° around the lower roller, and up through the space between upper rollers.

Figure 11:
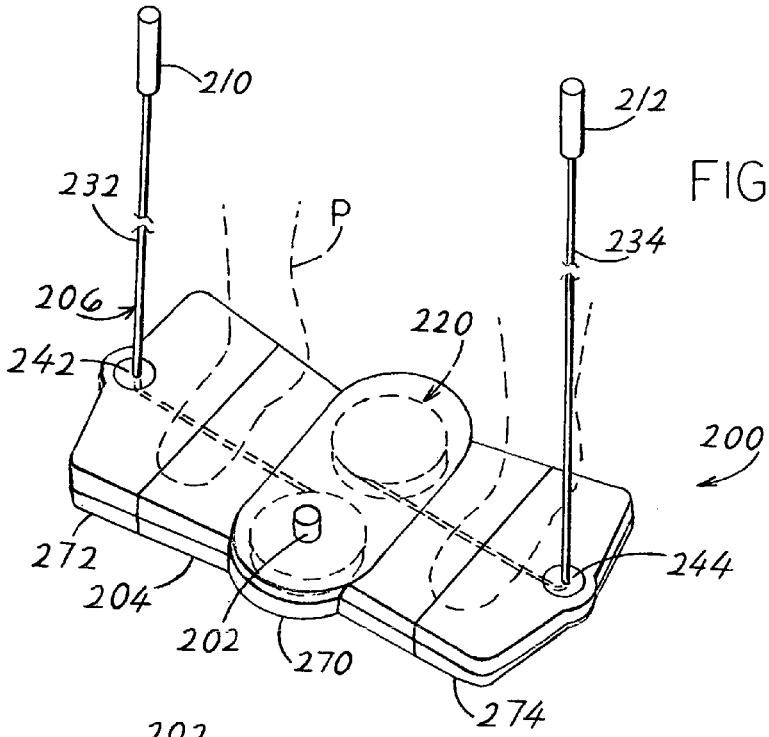
FIG. 11 is an isometric view of an exercise apparatus of a third embodiment of the invention, wherein the element for operating a release mechanism lie in the housing.

FIG. 11 illustrates an apparatus, or exercise unit 200 of another embodiment of the invention. In FIG. 11, a person P standing on the unit base 204, can lengthen or shorten the cable 206 by stepping on an actuator 202, in the form of a button located on the base. As in the first embodiment of FIGS. 1-9, the person pulls up one or both handles 210, 212 while the actuator 202 is depressed, to lengthen the cable. Conversely, the person lowers one or both handles while the actuator is depressed, to shorten the cable.

Figure 12:
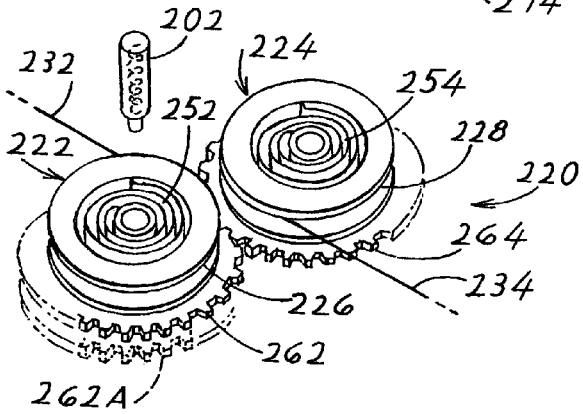
FIG. 12 is a partial isometric view of windup spools and gears of FIG. 11, with the gears shown in solid lines when the operating element is not depressed, and with one of the gears shown in phantom lines when the operating element is depressed.

FIGS. 11 and 12 show that the mechanism 220 that allows the cable length to be changed includes two cable length-controlling devices 222, 224, each with a spool 226, 228. The cable includes two cable halves 232, 234, each partially wound onto one of the spools, and each extending from the corresponding spool. Each cable half extends through a cable guide 242, 244 to one of the handles.

Each length-controlling device includes a clock spring 252, 254 with one end fixed to a spool and an opposite end fixed to the housing. Each spring tends to turn the corresponding spool 226, 228 to wind up the corresponding cable half and thereby shorten the cable. Each length-controlling device also includes a gear 262, 264 connected to a corresponding spool and engaged with the other gear.

In the usual operation of the unit 200, when the actuator 202 is not depressed, the gear-connected spools turn in opposite directions. Thus, when one spool turns to pay out cable the other turns to wind up cable, to maintain a constant effective length of the cable.

To enable a change in effective length of cable, a person steps on an operating element or actuator 202. This moves down the first gear to position 262A out of engagement with the other gear. The spools 226, 228 then each tends to independently wind up its cable half to shorten the cable but can be turned in the other direction. If one handle (or both) is pulled to overcome the clock spring torque applied to the corresponding spool, then that spool turns in a direction to pay out cable and lengthens the effective length of the cable. If one handle (or both) is moved down, the corresponding spool will wind up the corresponding cable half to shorten the effective length of cable.

In FIG. 11, the base is divided into a central section 270 and two outer section 272, 274. The outer sections are pivotally connected to the center section so they can pivot to lie under the center section for more compact storage.

Figure 13:
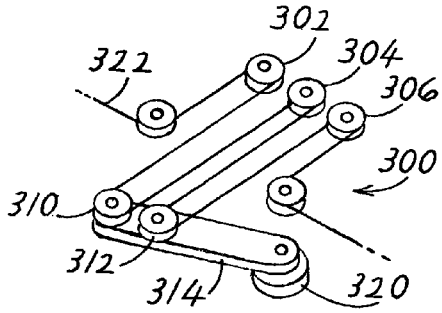
FIG. 13 is a partial isometric view of an exercise apparatus of a fourth embodiment of the invention.

A variety of mechanisms can be used in the base to lengthen or shorten the cable. FIG. 13 shows a portion of a unit 300 with a group of fixed rollers 302, 304, 306, and with a group of moveable rollers 310, 312 that are mounted on a bar 314. The bar is moveable (by pivoting or sliding) to move rollers 310, 312 toward and away from the fixed rollers. A spring 320 urges the bar to more the moveable rollers away from the fixed ones. The cable 322 of FIG. 13 extends around the rollers as illustrated. At any position of the bar 314, the bar is fixed at that position by a bar brake (not shown) except when an actuator on the base is depressed.

Thus, the invention provides a compact exercise apparatus of a type wherein handles lie at opposite ends of a rope that extends through a housing (although the rope can be interrupted by being formed of two separate rope halves). The invention provides mechanisms that can be operated by a person holding grips at both handles, that allows the cable or rope effective length to be increased or decreased or maintained constant by the person moving one or both handles toward or away from the base. One mechanism includes a rope storage device such as a spool, lying in one of the handles. An actuator, or operable element on the handle such as a push button, releases the mechanism to pay out or draw in rope. Another mechanism is a rope storage device in the base and an actuator element on the base, such as a push button, that can be operated by a person's foot.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. Exercise apparatus of the type that includes a housing with at least one rope guide, a rope that extends through said at least one rope guide and that has rope portions on opposite sides of said at least one rope guide, a pair of handles that are each coupled to a different one of said rope portions and that each has a grip that can be grasped by fingers of a hand to pull said different rope portions, and a mechanism that is manually operable to enable lengthening or shortening of said rope portions, comprising:

at least one windup spool coupled to said rope, and a spring device that urges said spool to turn to windup rope thereon and that allows said spool to turn to unwind rope therefrom, to respectively shorten and lengthen at least one of said rope portions, but only when said spool is released to wind up rope;

a manually operable release mechanism that normally prevents rotation of said spool and that is operable by a person while that person grasps said grips of said handles, to release said spool to windup or unwind rope;

said release mechanism being capable of being not operated to not release said spool and being capable of being operated to release said spool, all while a person grasps said grips of said handles and pulls the handle away from said at least one rope guide to lengthen a rope portion or allows the handle to move toward said at least one rope guide to shorten a rope portion;

said rope portions being coupled so a person can pull one rope portion to apply tension to lengthen it while applying about the same tension to the other rope portion to resist shortening it.

2. The apparatus described in claim 1 wherein:

said grips are each largely in the form of a shaft and each has an axis;

said manually operable release mechanism includes a manually moveable member that lies at an end of one of said grips so said manually moveable member can be moved by the thumb of a hand of a person while the person grasps the shaft with the rest of the fingers of said hand.

3. The apparatus described in claim 2 wherein:

said movable member is a push button that is depressable along said grip axis.

4. The apparatus described in claim 1 wherein:

said grips are each largely in the form of shaft with a shaft axis;

a first of said handles forms a spool housing and said spool is rotatably mounted in said spool housing;

said spool has an axis of rotation that is perpendicular to the shaft axis, whereby to provide a large diameter spool that does not hit a person's side when the corresponding grip is moved up and down beside the person's body.

5. The apparatus described in claim 1 wherein:

said manually operable release mechanism includes a manually moveable member that lies on said housing for operation by a foot of the person while the person holds said grips of said handles.

6. The apparatus described in claim 1 wherein:

said at least one rope guide comprises a pair of laterally-spaced rope guides in said housing, each rope guide including a pair of longitudinally spaced upper rollers that are rotatable about parallel lateral axes and a lower roller that lies below said upper rollers and that is rotatable about a longitudinal axis that is perpendicular to said lateral axes, and said housing forms a housing passage that extends between said rope guides;

said rope extends largely vertically from each of said handles to a location between a pair of said upper rollers, said rope extends around the lower roller of each of said rope guides, and said rope extends through said housing passage between the lower rollers of said rope guides.

7. The apparatus described in claim 1 wherein:

said at least one rope guide comprises a single rope guide which includes a pair of upper rollers that are rotatable about parallel first axes and a lower roller that is rotatable about a second axis that is perpendicular to said first axes and that lies below said upper rollers;

said rope extends from a first of said handles between said upper rollers, around said lower roller, and again between said upper rollers to a second of said handles.

8. The apparatus described in claim 1 wherein:

said housing is constructed to withstand the weight of a person; and including a pair of foot markings on said housing, said foot markings lying on opposite sides of said at least one rope guide.

9. Exercise apparatus of the type that includes a housing with at least one rope guide, a rope that extends through said at least one rope guide and that has rope portions on opposite sides of said at least one rope guide, and a pair of handles that are each coupled to a different one of said rope portions, wherein:

said at least one rope guide includes a pair of upper rollers with primarily longitudinally elongate cylindrical roller surfaces of a coaxial length equal to a plurality of diameters of said rope, that are rotatably mounted about largely parallel first axes on said housing and that are separated by more than a diameter of said rope, and said rope guide includes a lower roller that lies under said upper rollers to directly receive and pay out a rope portion from and to a gap between the upper rollers and that is rotatably mounted on said housing about a second axis that is primarily perpendicular to said first axes, said lower roller having a primarily cylindrical roller surface with a length equal to a plurality of diameters of said rope;

wherein said longitudinally elongate cylindrical roller surfaces allow said rope to extend at a wide range of angles from the vertical out of said at least one rope guide.

10. The exercise apparatus described in claim 9 wherein said housing has perpendicular lateral and longitudinal dimensions, and wherein:

said at least one rope guide includes two laterally spaced rope guides, each rope guide having a pair of upper rollers each rotatable about a primarily lateral axis and being longitudinally spaced apart to receive said rope between them, and each rope guide having a lower roller that lies below said upper rollers and that is rotatable about a primarily longitudinal axis;

said rope extends from a first of said handles, between a first pair of said upper roller and around a first one of said lower rollers, said rope extending laterally from said first lower roller to a second one of said lower rollers and around said second lower roller, between a second pair of said upper rollers, to the second handle.

11. The exercise apparatus described in claim 9 wherein:

said at least one rope guide includes a first rope guide;

said rope extends from a first of said handles down through the space between said upper rollers, around said lower roller, and up through said space between said upper rollers to a second of said handles.

12. The apparatus described in claim 9 wherein:

said housing has a bottom surface for resting on a floor and a top surface with a flat surface portion on which a person can stand, said top surface having a hole aligned with said upper rollers, and said housing having a raised mound lying about said hole with said mound lying above the level of said flat surface portion, to thereby keep a person's foot away from the opening.

13. The apparatus described in claim 9 including:

at least one windup means mounted in said housing, which is operable for storing some of said rope and for lengthening and shortening the sum of the lengths of rope that extends between said rope guide and said handles;

a manually operable release mechanism which includes a release member that is mounted on said housing and that is operable by a foot of a person who holds said handles, said release mechanism preventing said windup means from lengthening and shortening said sum of the lengths of rope until said release member is operated.

14. Exercise apparatus of the type that includes a housing with at least one rope guide, a rope that extends through said at least one rope guide and that has rope portions on opposite sides of said at least one rope guide, a pair of handles that are each coupled to a different one of said rope portions and that each has a grip that can be grasped by fingers of a hand to pull said different rope portions, and a mechanism that is manually operable to enable lengthening or shortening of said rope portions, comprising:

at least one windup spool coupled to said rope, and a spring device that urges said spool to turn to windup rope thereon and that allows said spool to turn to unwind rope therefrom, to respectively shorten and lengthen at least one of said rope portions, but only when said spool is released to wind up rope;

a manually operable release mechanism that normally prevents rotation of said spool and that is operable by a person while that person grasps said grips of said handles, to release said spool to windup or unwind rope;

said release mechanism being capable of being not operated to not release said spool and being capable of being operated to release said spool, all while a person grasps said grips of said handles and pulls the handle away from said at least one rope guide to lengthen a rope portion or allows the handle to move toward said at least one rope guide to shorten a rope portion;

said at least one rope guide includes a pair of upper parallel roller that are rotatably mounted on said housing about parallel first axes and that are spaced apart by more than a diameter of said rope, and a lower roller that is rotatably mounted on said housing about a second axis that is perpendicular to said first axes, said rope extending between said upper rollers and at least partially about said lower roller.

15. Exercise apparatus of the type that includes a housing with at least one rope guide, a rope that extends through said at least one rope guide and that has rope portions on opposite sides of said at least one rope guide, and first and second handles that are each coupled to a different one of said rope portions, said first and second handles having first and second grip shafts that each has a shaft axis wherein:

said at least one rope guide includes a pair of upper rollers that are rotatably mounted about largely parallel first axes on said housing and that are separated by more than a diameter of said rope, and a lower roller that lies under said upper rollers and that is rotatably mounted on said housing about a second axis that is primarily perpendicular to said first axes; and including a windup spool rotatably mounted in a first of said handles and a spring in said first handle that turns said spool to windup said rope and that allows said spool to turn to unwind rope from said spool;

a manually operable release mechanism that normally prevents rotation of said spool and that is operable by the thumb of a hand of a person who grasps said first grip shaft with other fingers of the same hand, to release said spool to windup or unwind rope thereon.

* * * * *